US005839486A

United States Patent [19]

Buesing

[11] Patent Number: 5,839,486

[45] Date of Patent: Nov. 24, 1998

[54] FILL SYSTEM INCLUDING A FILL PUMP POSITIONING SYSTEM

[75] Inventor: Jonathan P. Buesing, Maplewood, Minn.

[73] Assignee: Tetra Laval Holdings & Finance, SA, Pully, Switzerland

[21] Appl. No.: 825,135

[22] Filed: Mar. 28, 1997

[51] Int. Cl.[6] ..... B65B 43/42

[52] U.S. Cl. ..... 141/177; 141/235; 141/237; 141/266; 141/376

[58] Field of Search ..... 141/152, 177, 141/266, 376, 235, 237; 414/796.2

[56] References Cited

U.S. PATENT DOCUMENTS 3,900,054 8/1975 Hamer et al. .
4,424,937 1/1984 Nawa et al. .
5,000,661 3/1991 Bloch et al. .
5,033,518 7/1991 Ruhl .
5,305,809 4/1994 Pringle ..... 141/235
5,425,402 6/1995 Pringle .
5,494,085 2/1996 Zink .

*Primary Examiner*—David J. Walczak
*Assistant Examiner*—Timothy L. Maust
*Attorney, Agent, or Firm*—Michael A. Catania

[57] ABSTRACT

An apparatus for use in a filling system is provided. The apparatus includes a product filling machine having a top portion and a base portion. A conveyor is also provided for transporting containers to be filled in a conveying direction. The conveyor is arranged on the base portion of the filling machine. A fill pump system is arranged at the top of the filling machine above the conveyor. An adjustable mounting mechanism for connecting the fill pump system at the top of the filling machine and for adjusting the location of the fill pump system in the conveying direction is also provided.

8 Claims, 10 Drawing Sheets

FILL SYSTEM INCLUDING A FILL PUMP POSITIONING SYSTEM

BACKGROUND OF THE INVENTION

The present invention relates to a machine for filling containers, and more particularly, to an adjustable fill pump system for use in a packaging machine that compensates for conveyor wear so that the packaging machine continues to operate properly despite the conveyor wear.

Packaging machines are known that integrate the various components necessary to fill and seal a container into a single machine unit. This packaging process, generally stated, includes feeding carton blanks into the machine, sealing the bottom of the cartons, filling the cartons with the desired contents, sealing the tops of the cartons, and then off-loading the filled cartons for shipping.

Trends within the field of packaging machines point toward increasingly high capacity machines capable of rapid, continuous filling and sealing of a very large number of identical or similar packaging containers, e.g., containers of the type intended for liquid contents such as milk, juice, and the like. One such machine is disclosed in U.S. Pat. No. 5,488,812, issued Feb. 6, 1996, and entitled "A Packaging Machine." The machine disclosed in that patent includes a plurality of processing stations, each station implementing one or more processes to form, fill, and seal the containers. Each of the processing stations is driven by one or more servomotors that drive the various components of each of the processing stations.

The increased throughput and decreased size requirements of packagers on their packaging machines have increased the demands that are placed on the fill systems that are employed. Various apparatus and corresponding methods for filling containers, such as gable-top containers, have therefor been devised for these machines. In accordance with one of the more popular filling methods, the container is lifted from a conveyor to a fill pipe by means of a lifting mechanism. The container lifting mechanism gradually lowers the container as product is dispensed through the fill tube. The container then again engages the conveyor where it is transported to a top sealing station. Such a method is utilized in TR/7™ and TR/8™ packaging machines manufactured and available from Tetra Pak, Inc.

Alternatively, the filling and top sealing operations may be performed at a single location within the machine. In such instances, the container may be top sealed after it has been lowered from the fill pipe. Such a method and apparatus are shown and described in the '812 patent, and in U.S. Ser. No. 08/315,414, filed Sep. 28, 1994 and entitled "A Control System For A Packaging Machine."

Certain systems utilize a conveyor having some sort of chain link arrangement or chain drive for transporting the containers to successive stations in the packaging machine during a filling operation.

Typically, the conveyor is incrementally indexed so that the containers to be filled are transported to an exact location below the fill pipe. As a result, the chain itself must remain taut and free of "slop" so that the proper location of the container beneath the fill pipe can be assured. However, normal wear and tear encountered during repeated operation of such a system tends to cause a loosening of component links of the chain, and consequently, an unacceptable lengthening of the chain. When this occurs, the containers are positioned "off their mark" under the fill pipe. This misalignment can cause improper filling and spillage during a filling operation.

As set forth above, since the chain experiences progressive wear over time, it must be either repaired or replaced at regular intervals. During normal filling operations performed in the time between repairs, adjusting the location of the components of the fill system can alleviate or correct the problems for a period of time. Such a compensating adjustment capability is beneficial, since replacing the chain increases the cost of running the machine by necessitating costly down time during which the machine is not producing.

BRIEF SUMMARY OF THE INVENTION

The inventors of this application have recognized a need for an adjustable fill system that compensates for conveyor wear as described above. To this end, an adjustable fill system is provided. The system includes a product filling machine having a top portion and a base portion. A conveyor is also provided for transporting containers to be filled in a conveying direction. The conveyor is arranged on the base portion of the filling machine. A fill pump system is arranged at the top of the filling machine above the conveyor. An adjustable mounting mechanism for connecting the fill pump system at the top of the filling machine and for adjusting the location of the fill pump system in the conveying direction is also provided.

An advantage provided by the present adjustable fill pump system is the capability to easily compensate for conveyor wear. The adjustable fill system allows movement of the fill pump and connected components to a proper position over the fill pipe to compensate for conveyor wear encountered over time.

The above-described structure and arrangement advantageously permit easy and quick adjustment of the fill pump relative to the conveyor. This beneficially avoids excessive down time of the machine during repair or replacement of the conveyor.

Other advantages of the invention will become apparent upon reference to the accompanying detailed description when taken in conjunction with the following drawings.

DETAILED DESCRIPTION OF THE INVENTION

Figure 1:
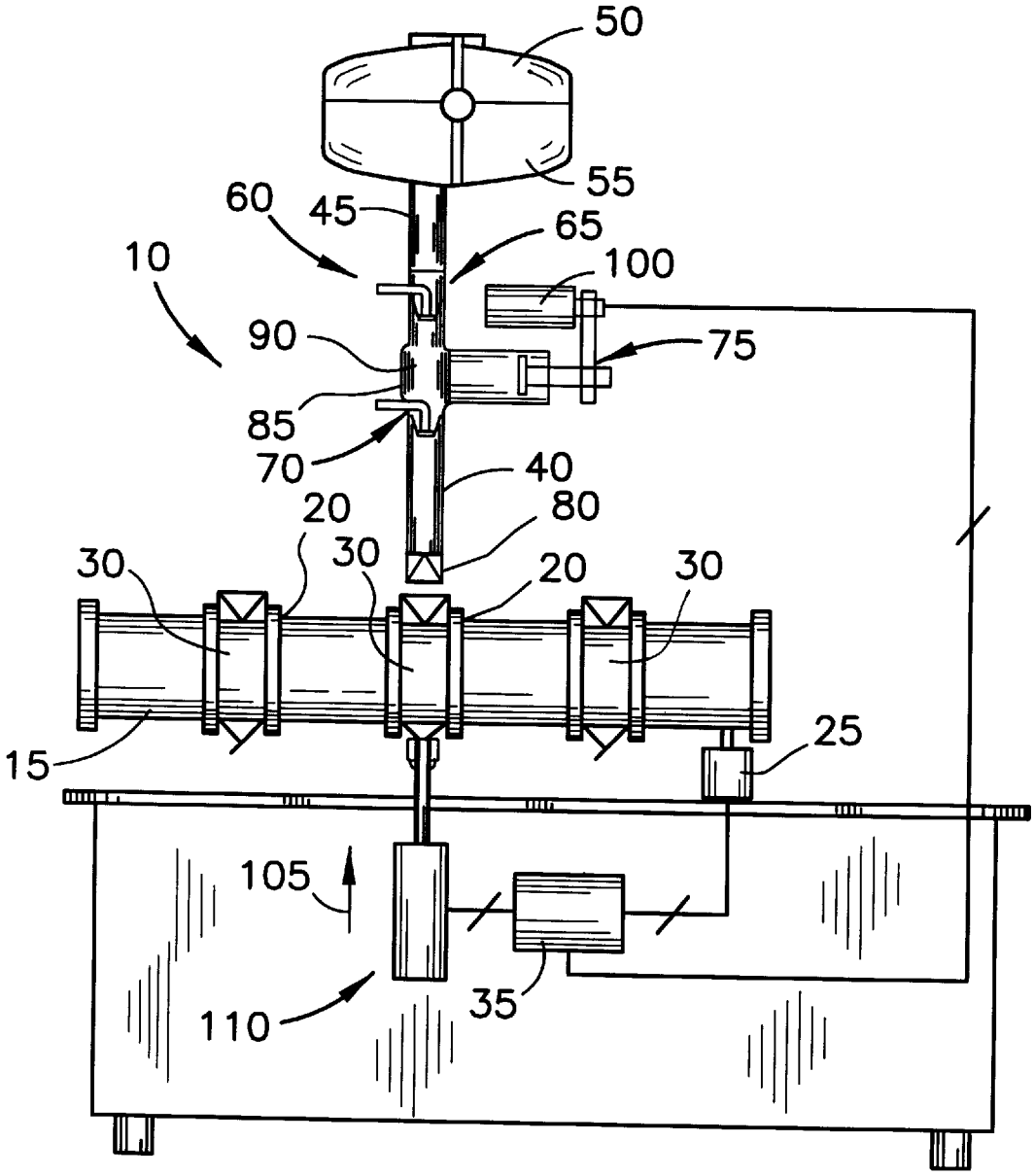
FIG. 1 is a partially diagrammatic view of a typical packaging machine that may incorporate the presently disclosed adjustable fill system.

FIG. 1 is a partial diagrammatic view of one of the many types of filling or packaging machines, shown generally at 10, that may utilize an adjustable fill system constructed and operated in the manner described herein. As shown in FIG. 1, a conveyor 15 having a plurality of container support members 20 is driven, for example, by a motor 25, such as a servomotor. The support members 20 each support a single, open topped container 30 that has its bottom sealed. The conveyor 15 is driven by the motor 25 under the control of, for example, a programmable control system 35, or the like, to present the containers 30 successively below a fill pipe 40 of the fill system 10.

A storage or balance tank 50 containing a liquid product 55 is connected to provide a flow of the liquid product 55 through a flow control system 60. The flow control system 60, generally stated, comprises an inlet valve assembly 65, an outlet valve assembly 70, a pump mechanism 75, the fill pipe 40, and a nozzle 80. The inlet valve 65 is arranged as part of a product inlet pipe 85. Similarly, the outlet valve 70 is arranged as a part of the fill pipe 40. The inlet valve 65 and outlet valve 70 are operated to control the flow of the liquid product 55 into and from a pump head cavity 90 of a pump head 95 of the pump mechanism 75. The pump mechanism 75 may be any type of pump mechanism, such as one disclosed in U.S. Pat. No. 4,877,160, which patent is incorporated by reference. The pump mechanism 75 may be driven, for example, by a servomotor 100 under the direction of the programmable control system 35.

As illustrated, the containers 30 are successively brought below the nozzle 80 for filling with the liquid product 55. To this end, each container 30 is lifted in the direction of arrow 105 so that the nozzle 80 is disposed in the interior of the container 30. This lifting may be done using a lifting mechanism 110 that executes a motion profile under the direction of, for example, the programmable control system 35. The flow control system 60 is then operated to fill the container 30 with liquid product 55 as the container 30 is lowered from the nozzle 80 by the lifting mechanism 110, preferably maintaining the nozzle 80 below the level of the liquid product 55 throughout this downward motion.

Figure 2:
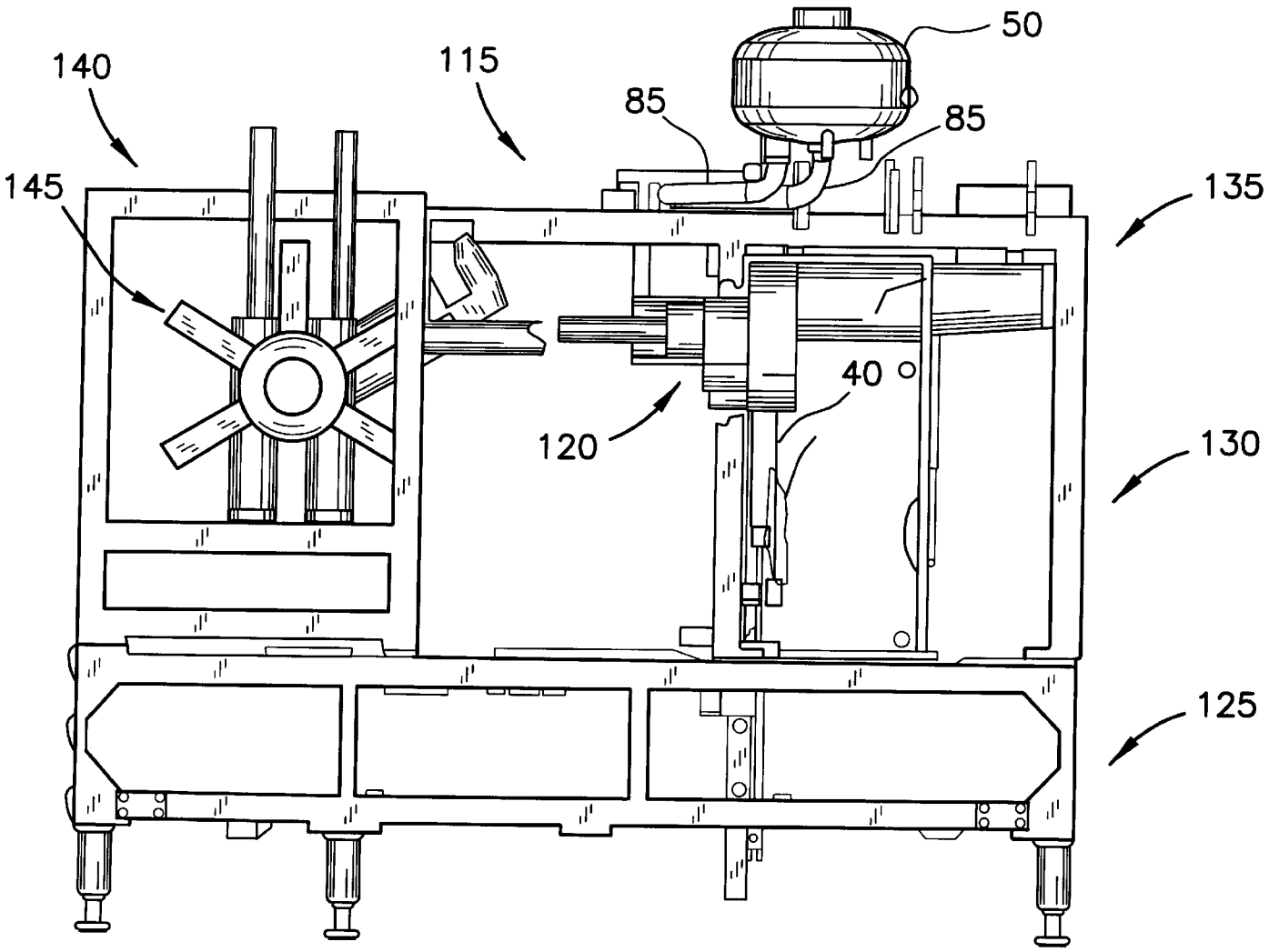
FIG. 2 is a side view of a packaging machine incorporating an embodiment of an adjustable fill system.

FIG. 2 is a side view of a packaging machine 115 incorporating an embodiment of an adjustable fill system shown generally at 120, wherein like numerals represent like parts. The packaging machine 115 comprises a base 125 and an upper frame 130 having a top 135.

As shown in FIG. 2, the storage tank 50 containing the liquid product 55 is arranged at or above the top 135 of the packaging machine 115. The illustrated embodiment includes two product inlet pipes 85 for separately filling containers on two parallel conveyors.

The packaging machine 115 of FIG. 2 also includes a container forming station 140 shown generally at the left end of the packaging machine 115. The adjustable fill system 120 is shown generally beneath the storage tank 50. The container forming station 140 has a rotating mandrel 145 for shaping a carton blank, for example, into the carton or container 30 to be filled with the liquid product after it is conveyed to, and properly located beneath, the fill tube 40 of the adjustable fill system 120. As generally shown in FIG. 2, and described further below with respect to FIG. 3, the adjustable fill system 120 is mounted to the top 135 of the packaging machine 115. The mounting of the adjustable fill system 120 at the top 135 of frame 130 above the containers 30 on the conveyors 15 advantageously provides aseptic benefits. Easier cleaning is also possible with such an arrangement.

For hygienic operation of the filling system, a shroud or the like may be used to isolate the components disposed above the inlet end of the fill pipe from the containers and associated filling area below the inlet of the fill pipe. To this end, the filling system may include a sterile air flow system such as one disclosed in U.S. Ser. No. 08/828,931 filed on even date herewith.

Figure 3:
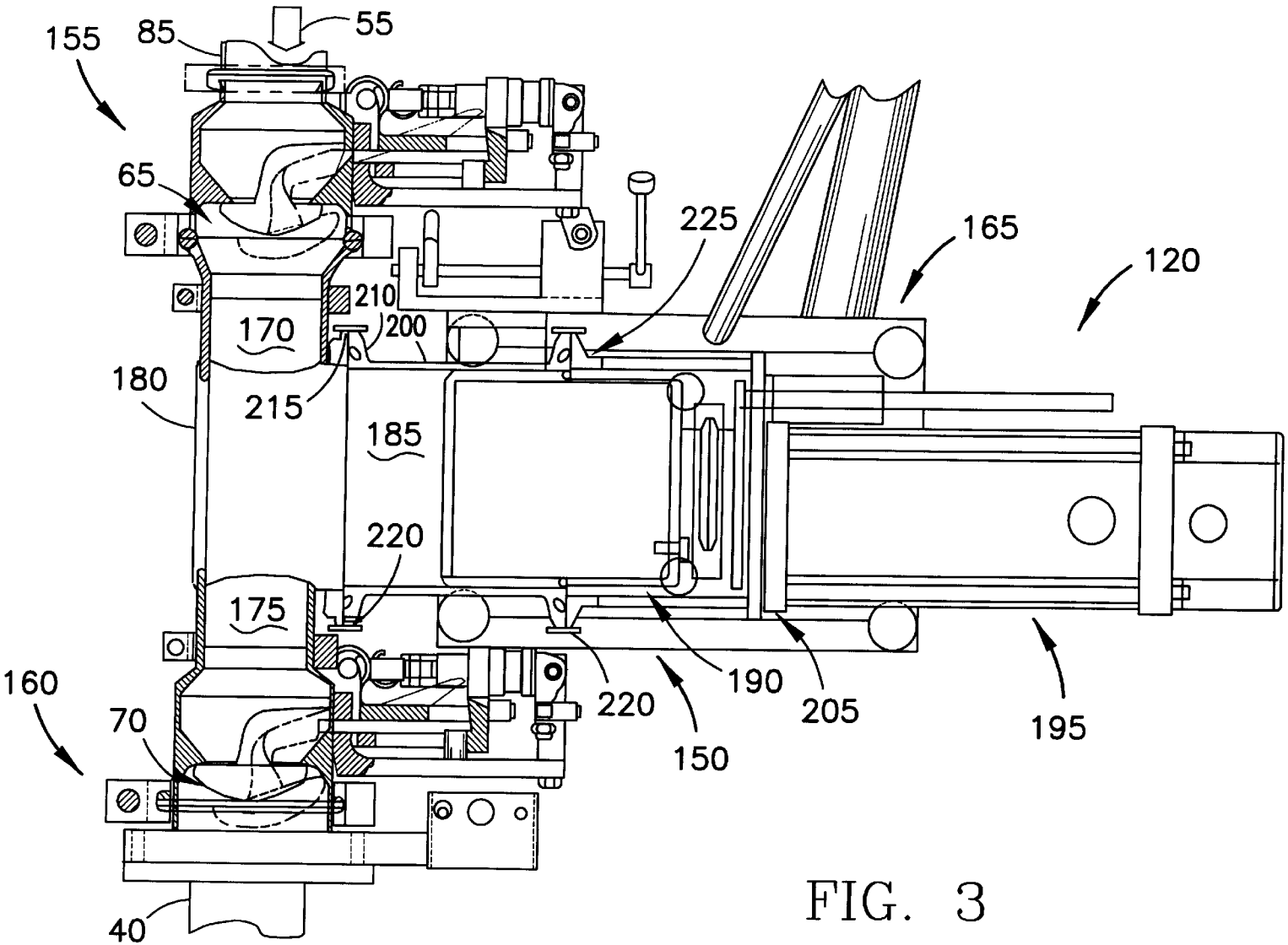
FIG. 3 is a side view in partial cross section of an embodiment of the adjustable fill system illustrating a fill pump assembly and connected components.

An adjustable fill system constructed in accordance with one embodiment of the invention is illustrated in FIG. 3, wherein like numerals represent like parts. Generally stated, the adjustable fill system 120 comprises a fill pump assembly 150, a product supply system 155, a product dispensing system 160, and a mounting assembly 165. As will be set forth below in further detail, the adjustable fill system 120 allows the product supply system 155, the fill pump assembly 150, and the product dispensing system 160 to be displaced, via the mounting assembly 165, longitudinally along the conveying direction to compensate for conveyor wear without requiring the removal or disconnection of the components from the packaging machine 115. To this end, the mounting assembly 165 supports both the product supply system 155, the fill pump assembly 150, and dispensing system 160. The mounting assembly 165 is discussed further below with reference to FIG. 5.

In the illustrated embodiment of FIG. 3, the fill pump assembly 150 comprises an inlet 170, an outlet 175, a pump head 180 in fluid communication with the inlet 170 and outlet 175, and a pump chamber 185 in fluid communication with the pump head 180. The fill pump assembly 150 also includes a piston and diaphragm assembly, shown generally at 190, that is driven to expand and reduce the volume of the pump chamber 185 by, for example, a linear drive mechanism, such as a screw-drive that is driven by a servomotor 195.

The fill pump assembly 150 is connected to receive product 55 from the product supply system 155 at the inlet 170. The product supply system 155 of the illustrated embodiment comprises the product supply tank 50 (FIG. 1), product inlet pipe 85, and inlet valve assembly 65. The fill pump assembly 150 is also connected to supply product to the product dispensing system 160. In the illustrated embodiment, the product dispensing system 160 comprises the outlet valve assembly 70 and the product outlet pipe or fill tube 40.

During a production cycle of machine operation, the liquid product 55 is drawn from the product supply tank 50 (FIG. 1) into the product inlet pipe 85 and passes through inlet valve assembly 65 into the pump head 180 and pump chamber 185. In this first cycle of operation, the outlet valve 70 is in a closed state. The inlet valve 65 is then closed and the outlet valve 70 is opened while the fill pump assembly 150 drives the liquid product out of the pump head 180 and pump chamber 185, through the outlet port 175, outlet valve 70, and the fill tube 40.

Generally stated, the fill pump assembly 150 is comprised of three separable components: the pump head 180, a pump chamber cylinder 200, and a motor carriage 205. The cylinder 200 defines the pump chamber 185 which is in fluid communication with the pump head 180. The pump head 180 is in fluid communication with the pump chamber 185 through an aperture.

As illustrated in FIG. 3, a flange portion 210 of the pump chamber cylinder 200 abuts a corresponding flange 215 of the pump head 180. The flange portions 210 and 215 are preferably held to one another by a v-band clamp 220. The "v" shape of the v-band clamp 220 advantageously envelops the sides and the top of the two adjacent flanges 210, 215. A similar arrangement at the opposite end of the pump chamber cylinder 200 is provided for the connection between the cylinder 200 and the motor carriage 205. Another v-band clamp 220 wraps around flange portions 210 and 225 of the cylinder 200 and motor carriage 205, respectively. Such an assembly facilitates fast and simple access to the various components of the fill pump assembly 150, including the piston and diaphragm assembly 190 disposed therein.

Figure 4:
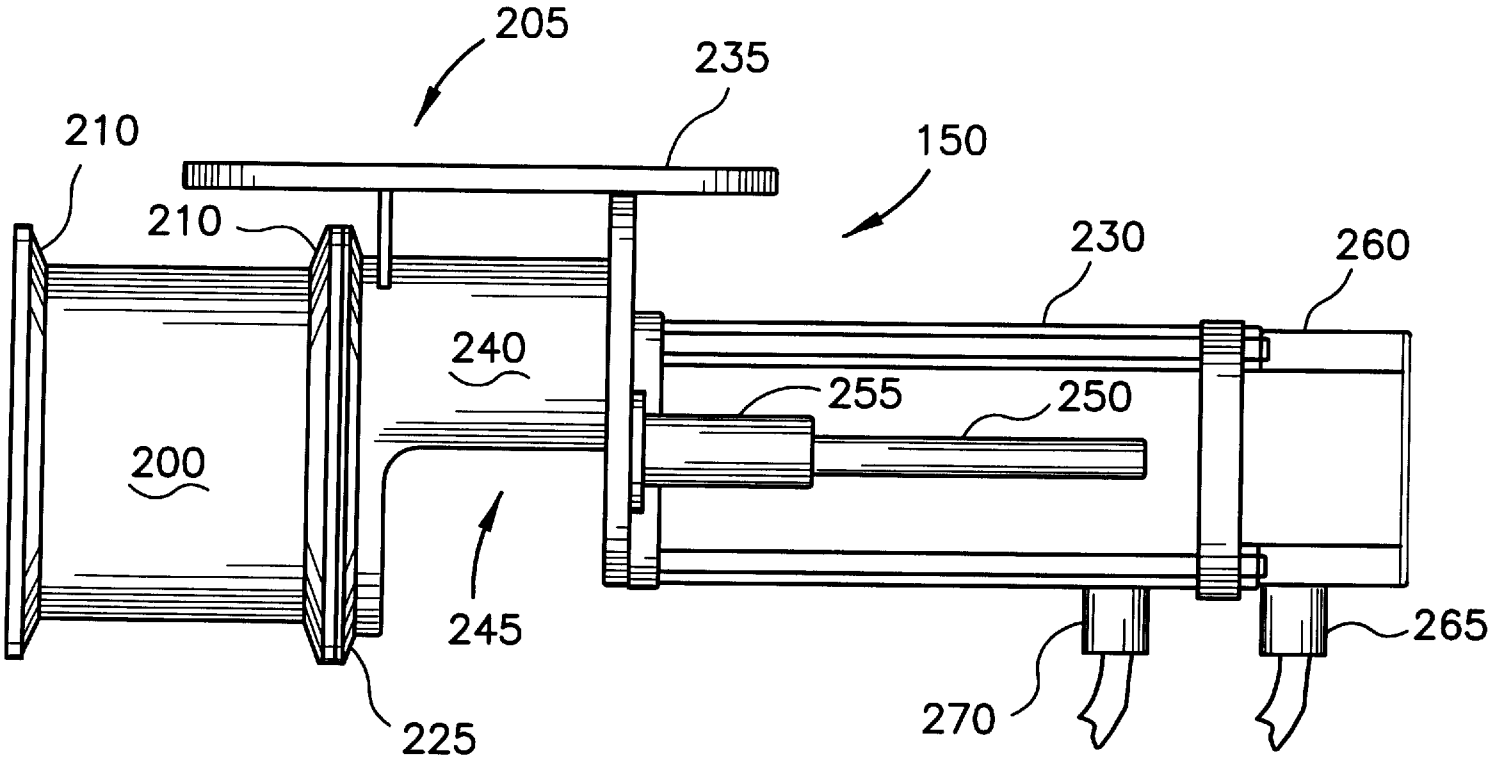
FIG. 4 is a top view of a portion of an embodiment of the fill pump assembly for use in the adjustable fill system.

FIG. 4 is a top view of a portion of the embodiment of the fill pump assembly 150 for use in the present adjustable fill system. FIG. 4 illustrates the motor carriage 205 connected between the cylinder 200 and a linear actuator 230. The motor carriage 205 includes a plate portion 235. The plate portion 235 of the motor carriage 205 is connected to a cylindrical portion 240 of the motor carriage 205. A cut-out portion 245 is provided in the cylindrical portion 240. The cutout portion 245 provides access for periodic repair and maintenance as described below. Also, an anti-rotation rod 250 and a stationary bushing 255 are illustrated. The anti-rotation rod 250 keeps the assembly from twisting during operation. In addition, an encoder or feedback device 260 is shown connected to the linear actuator 230. The encoder 260 provides feedback signals to control the dispensing of fluid product. An electrical connection 265 for the encoder 260 is provided. Similarly, an electrical connection 270 is provided for the linear actuator 230.

The linear actuator 230 is preferably a servo type unit. An example of a preferred device is a servo linear actuator available from EXLAR of Eden Prairie, Minn. This linear actuator 230 incorporates an inverted roller screw to provide precise control of the amount of fluid product 55 dispensed by precisely controlling the motion of the piston and associated diaphragms.

Figure 5:
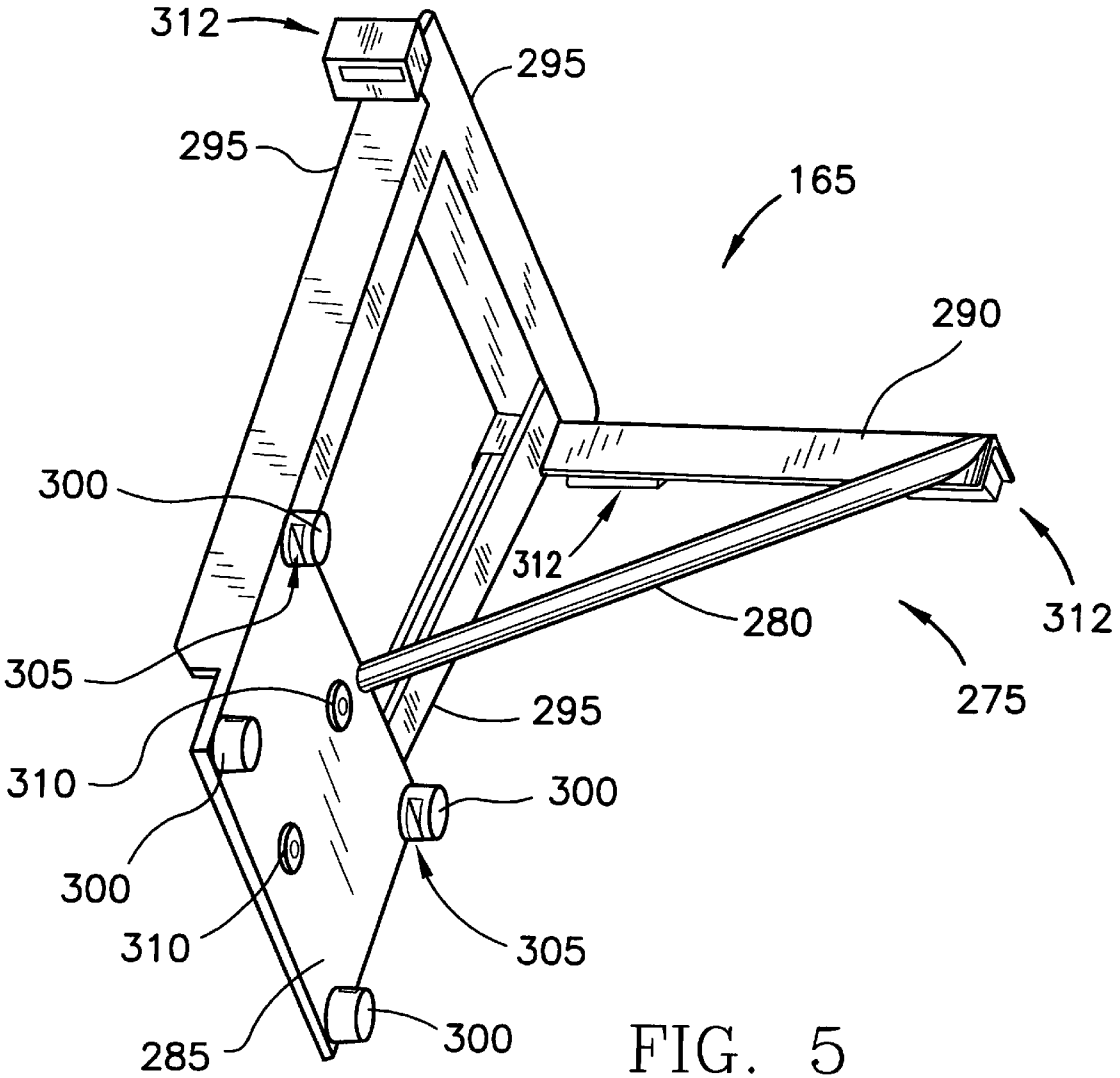
FIG. 5 is a perspective view of an embodiment of a mounting assembly for use in the adjustable fill system.

FIG. 5 is a perspective view of an embodiment of the mounting assembly 165 for use in the adjustable fill system 120. The mounting assembly 165 comprises a mounting bracket 275 that is supported in fixed alignment with the frame 130 of the packaging machine 115. The mounting bracket 275 supports the fill pump assembly 150.

Further, the embodiment of the mounting bracket 275 shown in FIG. 5 includes a support bar 280 extending from a mounting plate 285 to a cantilevered arm 290. In addition, frame members 295 are provided. The mounting plate 285 includes a plurality of mounting posts 300. The mounting posts 300 each preferably include a notch 305, which is preferably a machined guide groove. The plate portion 235 of the motor carriage 205 is arranged within the notches 305 of the mounting posts 300. This arrangement allows for longitudinal travel of the fill system within the packaging machine 115 to facilitate adjustment of the fill system with respect to, for example, the conveyor 15. In addition, a pair of raised bosses 310 are arranged on the mounting plate 285. The bosses 310 are provided for securing the motor carriage 205 to the mounting assembly 165 as explained further below.

As discussed above, such adjustments of the fill system are often necessary to compensate for misalignments between the outlet of the fill pipe 40 and the conveyor 15 that occur due to conveyor wear. This manner of adjustment of the fill system with respect to the conveyor 15 has many advantages over prior adjustment methods which only adjusted the position of the fill pipe alone, without a corresponding lateral adjustment of the other components of the fill system.

The notches 305 in the four mounting posts 300 also eliminate the need to machine large plate surfaces to obtain a smooth sliding surface. This results in a less costly mounting plate 285 of the mounting assembly 165 in terms of machining costs, as well as saving manufacturing time.

Further, as explained above, the motor carriage 205 is capable of sliding in the notches 305 of the mounting plate 285 of the mounting assembly 165. In addition, FIG. 5 illustrates a plurality of slotted bosses 312, which allows adjustment of the mounting assembly 165, the fill pump assembly 150, the product supply system 155, and the product dispensing system 160 with respect to the machine top 135. This capability for movement is also advantageous during the removal and reassembly of the fill system. Also, such an arrangement allows centering of the fill tube 40 perpendicular to the chain movement direction at the time of manufacture and after replacement of the chains.

Figure 6:
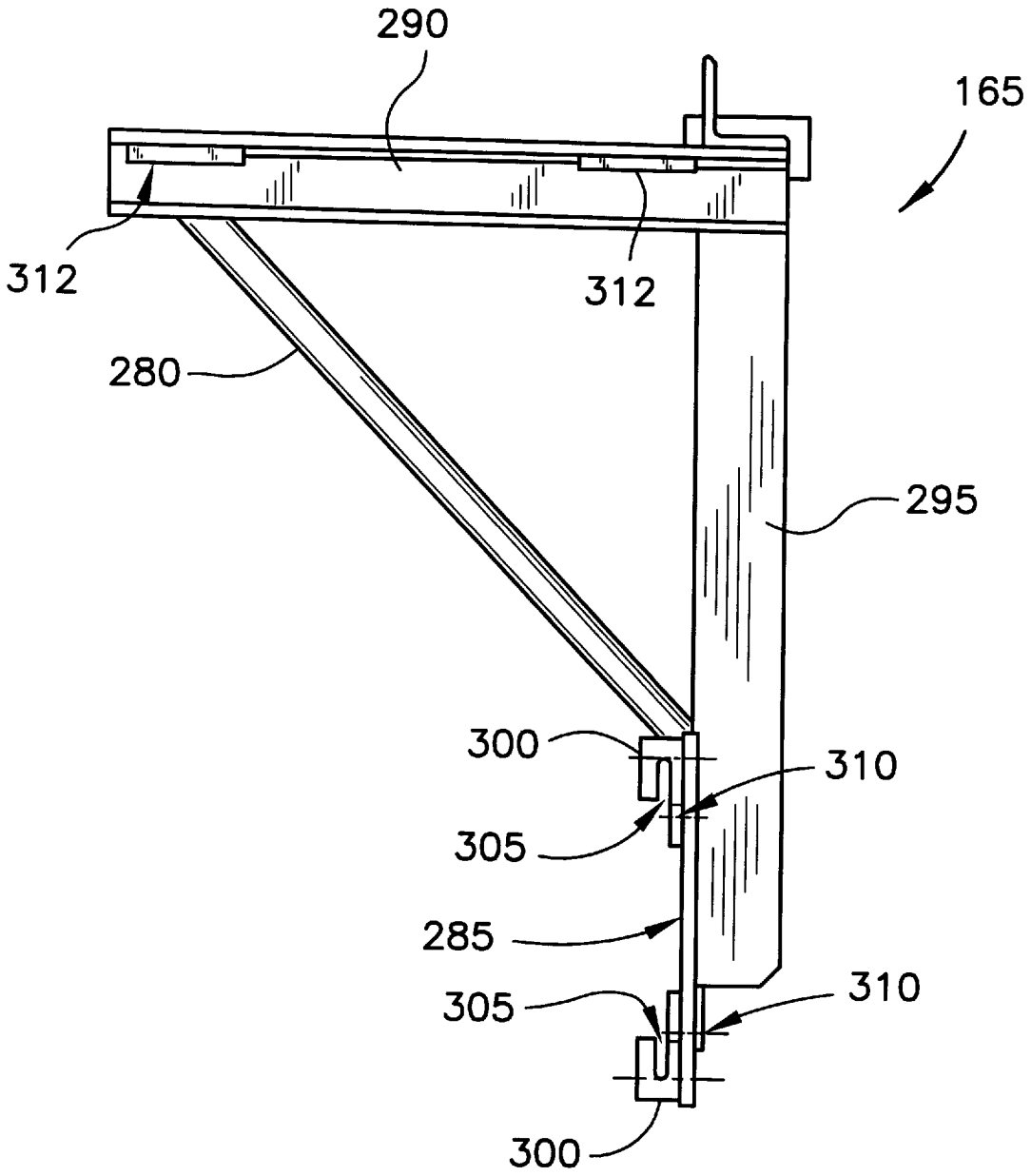
FIG. 6 is an end view of the embodiment of the mounting assembly of FIG. 5.

FIG. 6 is an end view of the mounting assembly 165 of FIG. 5 wherein like numerals represent like parts. FIG. 6 further illustrates the elements of the mounting assembly 165.

Figure 7:
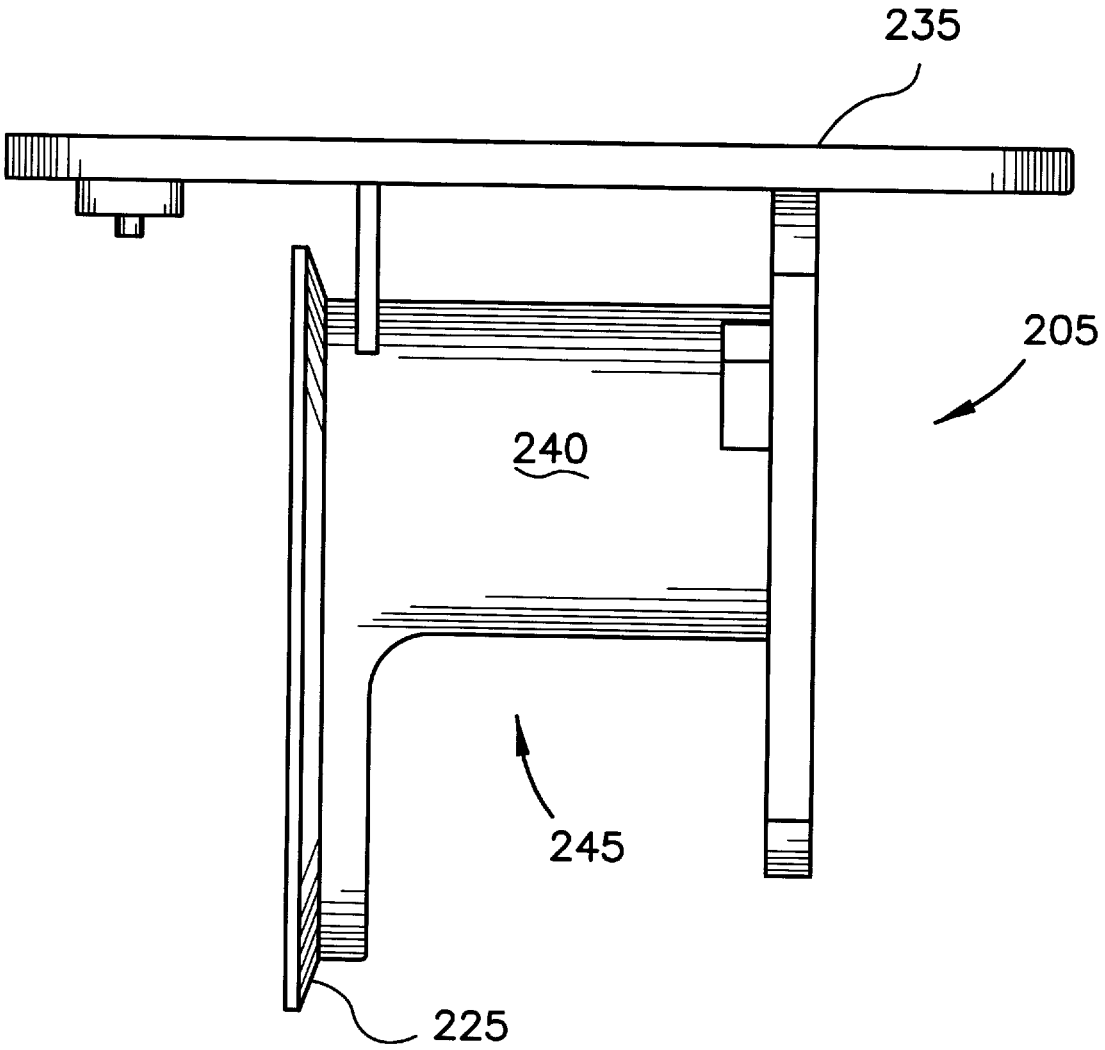
FIG. 7 is a top view of an embodiment of a motor carriage for use in the adjustable fill system.

FIG. 7 illustrates a top view of an embodiment of the motor carriage 205. The motor carriage 205 includes the plate portion 235 which rides within the notches 305 of the mounting plate 285. In addition, the flange portion 225 formed at an end of the cylindrical body 240 can be connected via the v-band clamp 220 to the cylinder 200 as shown in FIG. 3. The cylindrical body 240 of the motor carriage 205 also includes the cut-out portion 245 which allows user access to the connection between the linear actuator 230 and the piston and diaphragm assembly 190.

Figure 8:
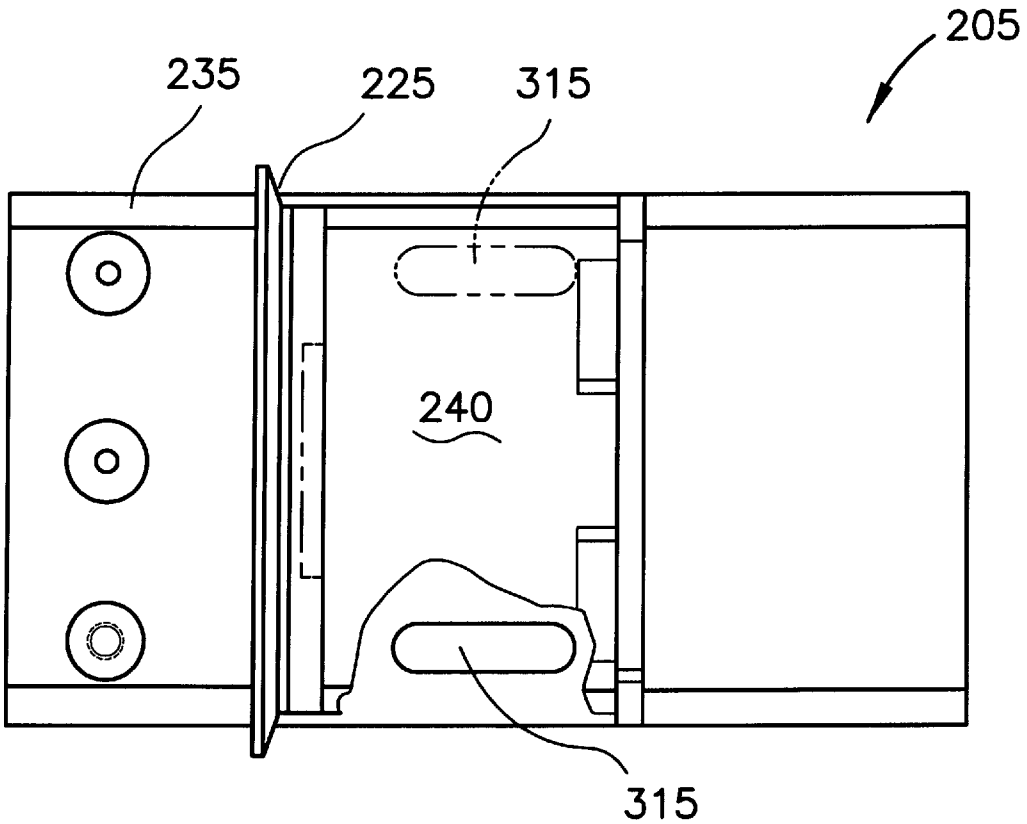
FIG. 8 is a side view of an embodiment of the motor carriage for use in the adjustable fill system illustrating adjustment slots.

FIG. 8 is a side view of the embodiment illustrated in FIG. 7 of the motor carriage 205 for use in the adjustable fill system 120 wherein like numerals represent like parts. FIG. 7 illustrates adjustment slots 315 formed in the plate portion 235 of the motor carriage 205. As explained below with reference to FIG. 9A and FIG. 9B, the location of the plate portion 235 of the motor carriage 205 is adjustable with respect to the conveyor 15 within the notches 305 of the mounting assembly 165.

Figure 9A:
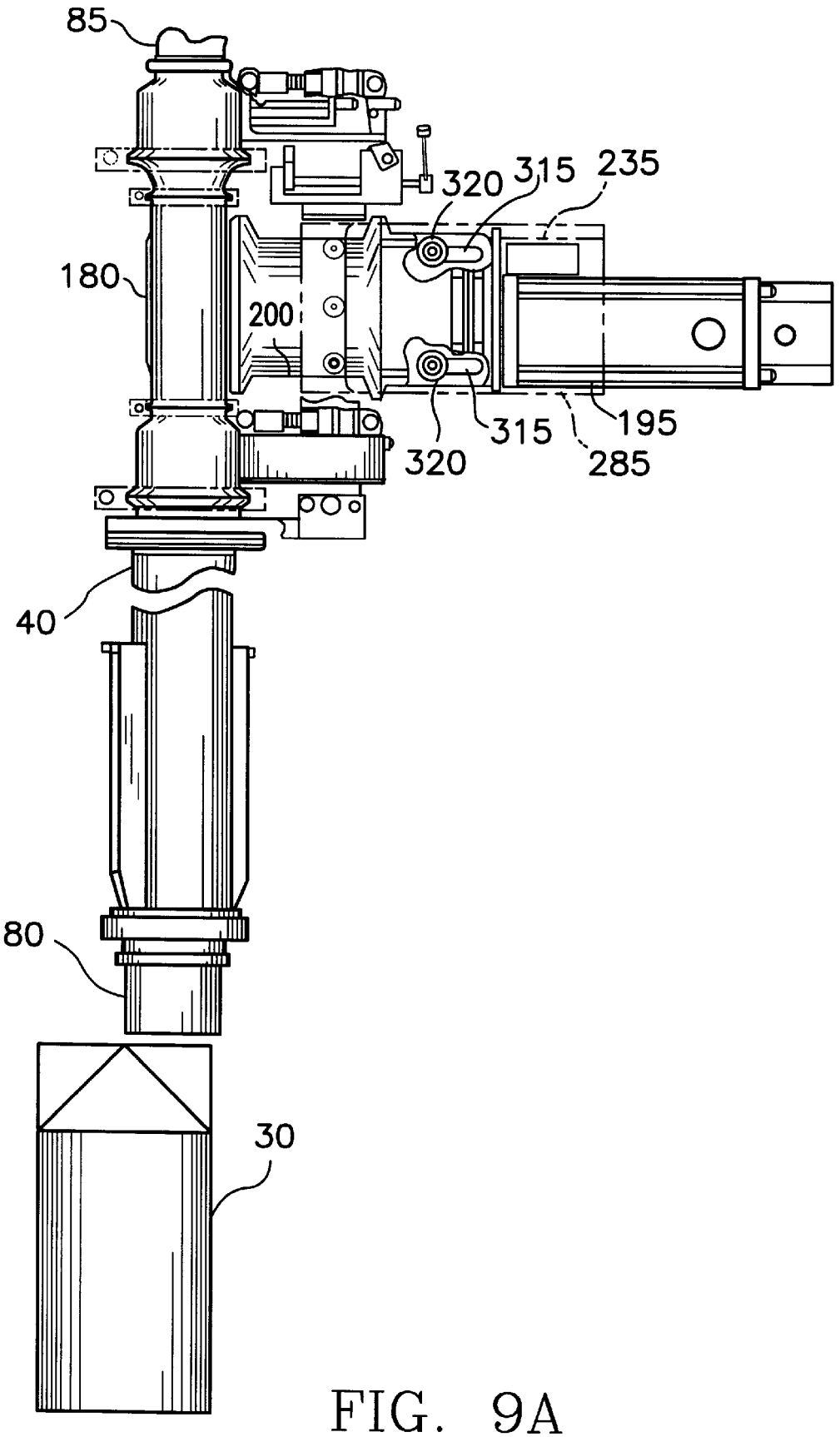
FIG. 9A is a side view in partial cross section of a portion of an embodiment illustrating the fill pump assembly arranged in a first position.

FIG. 9A is a side view in partial cross section of a portion of an embodiment of the adjustable fill system 120 illustrating the fill tube 40 of the fill system arranged in a misaligned first position. FIG. 9A illustrates a misalignment of the fill tube 40 relative to the container 30, possibly resulting from conveyor wear as discussed above. If a filling operation were to be performed with the container 30 in this position, spillage would likely occur and the container 30 would be inadequately filled.

As shown in FIG. 9A, the motor carriage 205 is secured to the mounting assembly 165. A securement 320, for example, a bolt, passes through the adjustment slots 315 of the plate portion 235 of the motor carriage 205. The securement 320 is then secured to the bosses 310 of the mounting plate 285 of the mounting assembly 165, which causes the motor carriage 205 to be held to the mounting assembly 165. Of course, since the fill pump assembly 150 and associated components are connected to and supported by the motor carriage 205, these elements of the fill system are also suspended in position by the mounting assembly 165.

Preferably, the securement 320 is a threaded bolt that screws into the threaded boss 310. In an exemplary embodiment, the securement 320 is a 16 mm bolt which passes through the adjustment slot having a width of 17 mm and a length of approximately 47 mm.

Figure 9B:
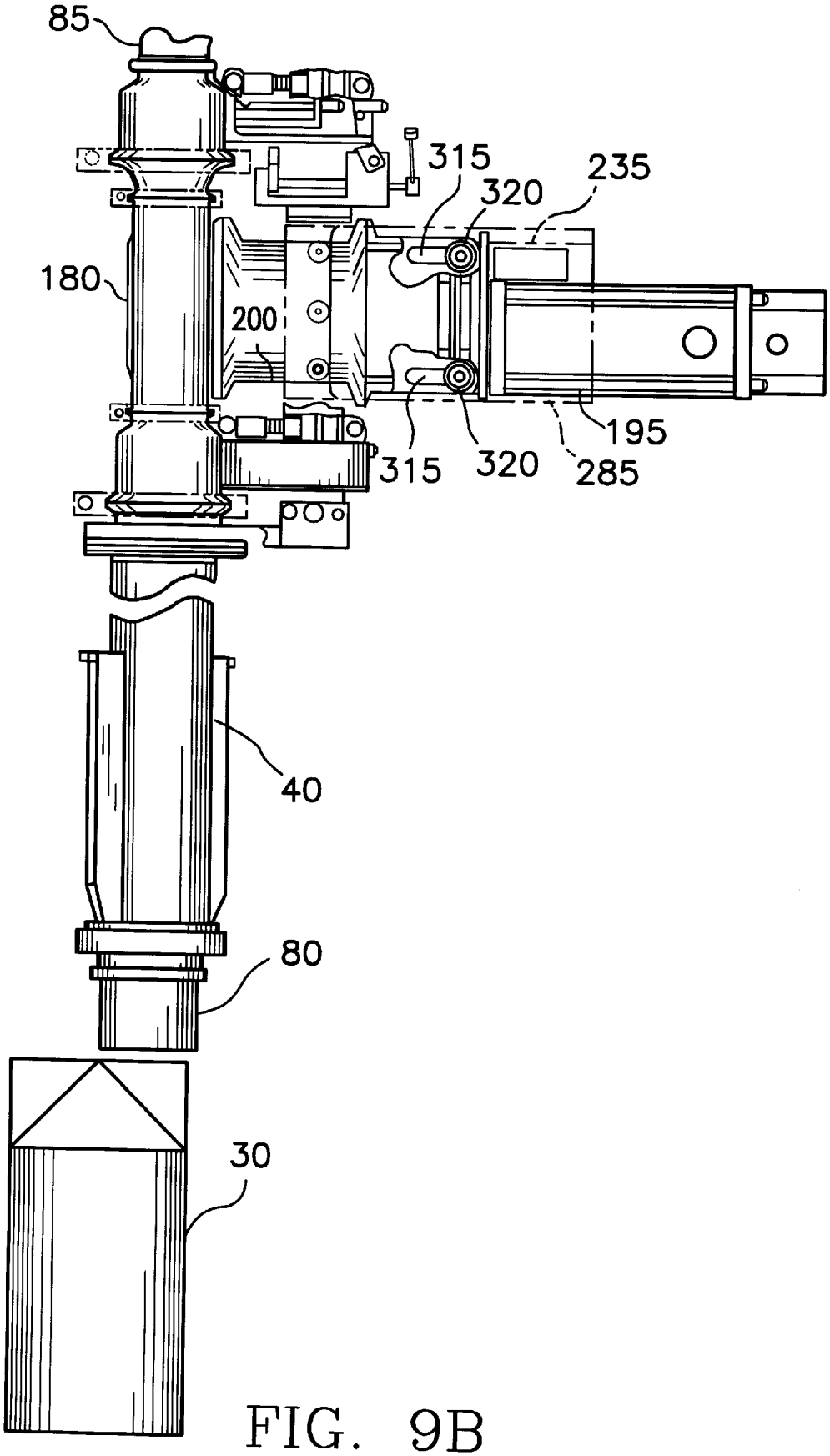
FIG. 9B is a side view in partial cross section of a portion of an embodiment illustrating the fill pump assembly arranged in a second position longitudinally displaced from the first position illustrated in FIG. 9A.

FIG. 9B is a similar view as presented in FIG. 9A illustrating the fill system arranged in an aligned second position wherein the fill pump assembly 150 is longitudinally displaced, with respect to the conveying direction, from the misaligned first position illustrated in FIG. 9A. The adjustable fill system 120 provides the capability to properly align the fill system (i.e., the fill tube 40) over the container 30 to ensure proper filling. During an adjustment of the fill system, the securement 320 is first loosened from engagement with the boss 310 of the mounting plate 285 of the mounting assembly 165. The securement 320 is loosened to such an extent that the plate portion 235 of the motor carriage 205 is free to longitudinally slide in the conveying direction within the notches 305 formed in the mounting posts 300 of the mounting assembly 165. The motor carriage 205 and connected fill pump assembly 150 are then free to move relative to the fixed mounting assembly 165, and thus relative to the conveyor 15. The appropriate adjustment in position to compensate for conveyor wear, for example, can be made by a technician. Once the motor carriage 205 is positioned properly, the securement 320 can again be fixedly engaged to the bosses 310 on the mounting plate 285 of the mounting assembly 165. In this manner, the fill system is located at the aligned second position to compensate for the wear in the conveyor 15 so that the fill tube 40 is properly aligned over the containers 30 which are presented by the conveyor 15.

Thus, when the fill system is in the aligned second position, after performing an adjustment procedure as discussed above, as illustrated in FIG. 9B, the securement 320 is displaced within the adjustment slot 315 of the motor carriage 205 by an amount equal to the difference in the first and second positions. The adjustment slots 315 thereby provide a guide for the securement 320 and a physically define a limit on the extent of travel of the motor carriage 205 and the fill system in the longitudinal conveying direction.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

I claim:

1. An apparatus for use in a filling system, the apparatus comprising:

conveying means for transporting containers to be filled in a conveying direction;

a fill pump system arranged above the conveying means;

a mounting bracket having a plate for adjustably positioning the fill pump system along the conveying direction;

a motor carriage connected to the fill pump system and including a plate portion; and a plurality of mounting posts, each post having a notch formed therein to receive the plate portion of the motor carriage.

2. The apparatus of claim 1 wherein the plate portion is adjustably positionable within the notches of the plurality of posts arranged on the plate of the mounting bracket.

3. The apparatus of claim 1 and further comprising:

an adjustment slot formed in the plate portion of the motor carriage;

receiving means arranged in the plate of the mounting bracket for engaging a securement; and a securement arranged to pass through the adjustment slot in the plate portion of the motor carriage and to engage the receiving means in the mounting bracket to thereby hold the motor carriage to the mounting bracket.

4. The apparatus of claim 3 wherein the securement comprises a threaded bolt and the receiving means comprises a correspondingly threaded hole.

5. The apparatus of claim 1 further comprising:

a securement constructed and arranged to hold the motor carriage to the mounting bracket.

6. An apparatus for use in a filling machine, the apparatus comprising:

a conveyor constructed and arranged to transport containers in a conveying direction in the filling machine;

a mounting bracket fixedly secured to the filling machine;

a fill pump system;

a motor carriage having a plate portion and connected to the fill pump system; and a plurality of a mounting posts arranged on the mounting bracket, each of the plurality of mounting posts having a notch formed therein to accept the plate portion of the motor carriage and for allowing movement of the motor carriage relative to the fixed mounting bracket.

7. The apparatus of claim 6 further comprising:

a securement for holding the motor carriage to the mounting bracket.

8. The apparatus of claim 6 further comprising:

an adjustment slot formed in the motor carriage;

receiving means arranged in the mounting bracket for engaging a securement; and a securement arranged to pass through the adjustment slot in the motor carriage and to engage the receiving means in the mounting bracket to thereby hold the motor carriage to the mounting bracket.

* * * * *